US007604575B2

(12) United States Patent
Papadopoulos

(10) Patent No.: US 7,604,575 B2
(45) Date of Patent: Oct. 20, 2009

(54) ROLLER TRAINER ASSEMBLY

(76) Inventor: Larry C. Papadopoulos, P.O. Box 1207, North Plains, OR (US) 97133

( * ) Notice: Subject to any disclaimer, the term of this patent is extended or adjusted under 35 U.S.C. 154(b) by 0 days.

(21) Appl. No.: 11/520,288

(22) Filed: Sep. 13, 2006

(65) Prior Publication Data

US 2007/0060453 A1 Mar. 15, 2007

Related U.S. Application Data

(60) Provisional application No. 60/716,852, filed on Sep. 14, 2005.

(51) Int. Cl.
*A63B 69/16* (2006.01)

(52) U.S. Cl. ..... 482/61; 482/54; 482/57

(58) Field of Classification Search ..... 482/51, 482/57, 61, 54; D21/663, 664, 669
See application file for complete search history.

(56) References Cited

U.S. PATENT DOCUMENTS

| | | | | |
|---|---|---|---|---|
| 2,498,047 | A * | 2/1950 | Myers | 601/93 |
| 4,779,863 | A | 10/1988 | Yang | |
| 5,492,516 | A * | 2/1996 | Trotter | 482/57 |
| 6,056,672 | A | 5/2000 | Carbonell Tendero | |
| 7,060,009 | B2 * | 6/2006 | Greenleaf | 482/61 |
| 2002/0055422 | A1 * | 5/2002 | Airmet et al. | 482/61 |
| 2004/0053751 | A1 * | 3/2004 | Pizolato | 482/61 |
| 2004/0077465 | A1 * | 4/2004 | Schmidt | 482/57 |
| 2005/0209064 | A1 * | 9/2005 | Peterson et al. | 482/61 |

FOREIGN PATENT DOCUMENTS

| | | | |
|---|---|---|---|
| FR | 2657024 | A1 * | 7/1991 |
| WO | WO 94/23807 | | 4/1994 |
| WO | PCT/NZ94/00030 | * | 10/1994 |

* cited by examiner

*Primary Examiner*—Loan H Thanh
*Assistant Examiner*—Tam Nguyen
(74) *Attorney, Agent, or Firm*—Timothy E. Siegel Patent Law, PLLC

(57) ABSTRACT

A bicycle exercise assembly adapted to be mounted on a supporting surface includes a bicycle trainer device, adapted to operatively support an exercising person. Also, a relative motion-permitting assembly is adapted to be supported by the surface and to support the bicycle trainer device and to permit relative motion between the bicycle trainer device and the surface.

13 Claims, 2 Drawing Sheets

ROLLER TRAINER ASSEMBLY

RELATED APPLICATIONS

This application claims priority from provisional application Ser. No. 60/716,852 filed Sep. 14, 2005.

BACKGROUND

A bicycle training device known as "bicycle rollers" has been available for over one hundred years. This device consists of three rollers supported by a frame. In use, the rear wheel of a bicycle is brought to rest on two, relatively closely spaced (by about 20 cm) bracketing rollers and the front wheel is balanced on top of the third roller. This device permits a user to balance and steer the bicycle (within a range) and to pedal at any speed desired. Unfortunately, users are constrained as to how aggressively they can exercise since rapid changes in pedaling speed and rider position can easily cause the rear wheel to pop out of its bracketing rollers. Additionally, a bicycle which is rigidly constrained acts to discourage the rider's natural movement and is somewhat uncomfortable to ride. It is a principle object of this invention to provide an additional degree of motion to more closely duplicate the natural feel of outdoor cycling.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a bicycle exercise assembly adapted to be mounted on a supporting surface and that includes a bicycle trainer device, adapted to operatively support an exercising person. Also, a relative motion-permitting assembly is adapted to be supported by the surface and to support the bicycle trainer device and to permit relative motion between the bicycle trainer device and the surface.

In a second separate aspect, the present invention may take the form of bicycle rollers that include a frame and front and rear rollers mounted in the frame, each having two lateral ends. Also, a pair of bumper/rollers are mounted on the frame adjacent both sides of the front roller. They are mounted so as to be horizontally rotatable, thereby acting to constrain a wheel of a bicycle supported by the front roller from moving laterally off the roller, while not stopping rotation of the bicycle wheel.

In a third separate aspect, the present invention may take the form of bicycle rollers that include a frame and front and rear rollers mounted in the frame. Also, a first rotatable bumper/roller is mounted on the frame, in front of and above the front roller and a second rotatable bumper/roller is mounted on the frame, in back of and above the pair of rear rollers. The first and second rotatable bumper/rollers act to constrain a bicycle wheel that has moved for or aft from its intended position, without braking the rotation of the bicycle wheel.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENTS

Figure 1A:
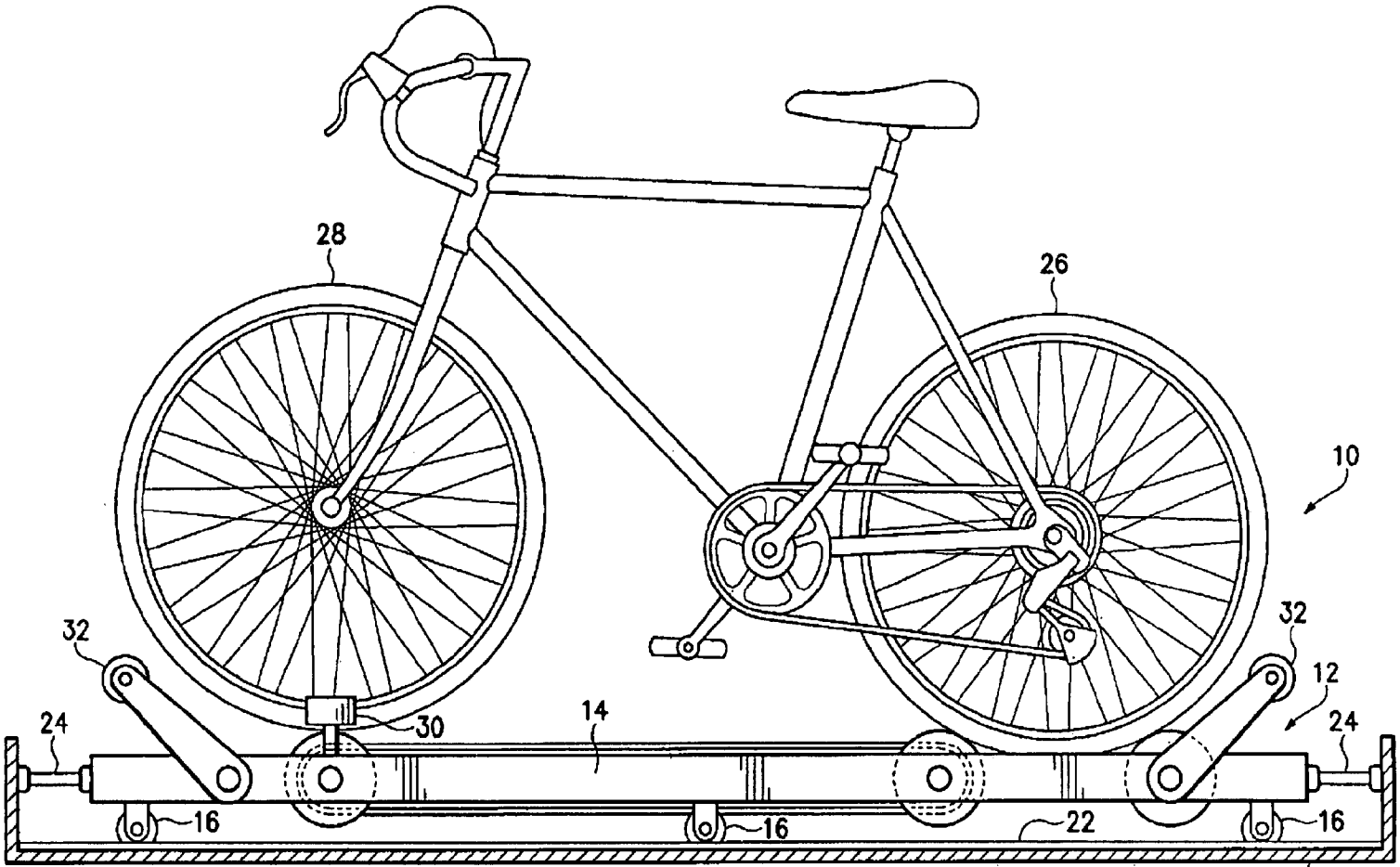
FIG. 1 is a side view of a bicycle training assembly according to a preferred alternative embodiment of the present invention.
Figure 2:
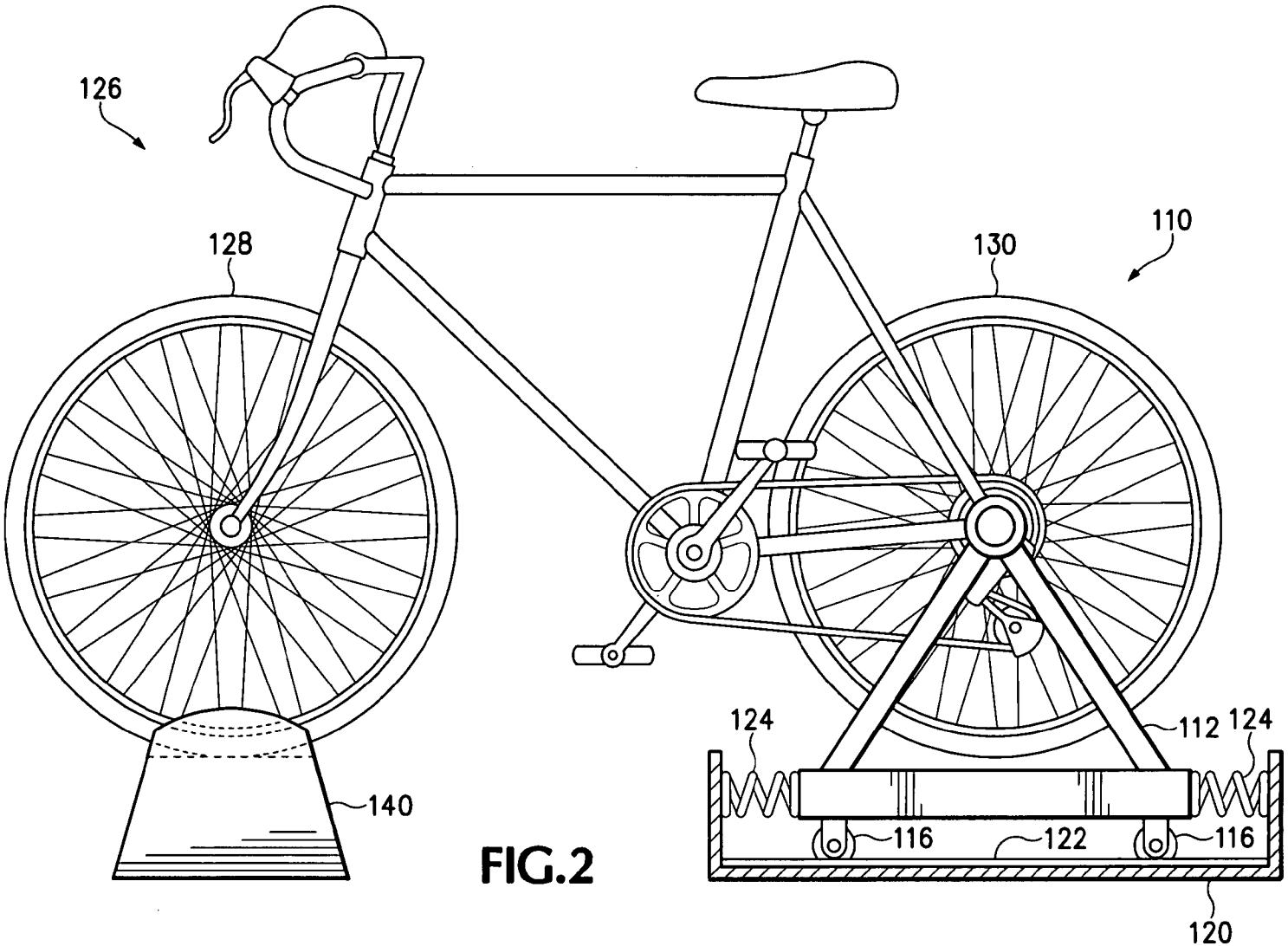
FIG. 2 is side view of a bicycle training assembly according to an alternative preferred embodiment of the present invention.

Referring to FIG. 1, a training assembly 10, includes a set of bicycle rollers 12 having a rollers frame 14, which is supported by wheels 16. In turn rollers 12 are constrained by an assembly frame 20, which also provides a pair of tracks 22 (only one shown) for wheels 16, thereby permitting relative motion between the rollers 12 and the assembly frame 20. Additionally, a light spring device 24 acts to gently return the rollers (and bicycle rider) to the center of the stroke whenever the rider's actions generate a plus or minus motion, thereby permitting equal amounts of forward and rearward motion from a central point. Preferably, a vibration damping spring, such as an elastomeric linear element (bungee) is used for spring 24.

In an alternative preferred embodiment a stationary exercise bicycle is mounted so that fore and aft movement relative to a supporting surface is permitted during use. In the context of this application the term "bicycle-utilizing bicycle trainer" is any device into which an actual bicycle is placed, prior to use. This includes both bicycle rollers and plain or basic trainers, but not exercise bicycles.

Providing a frame 20 into which the bicycle training device, such as bicycle rollers 12 is set, provides a smooth, hard surface for wheels 16 to rotate and permits the tethering of a spring that gently moves rollers 12 back to the center of frame 20 when the bicycle rider's motion has pulled rollers 12 for or aft. In an alternative preferred embodiment, however, frame 20 is not present and bicycle rollers 12, equipped with wheels 16, is set onto a hard smooth surface, such as a concrete or cement surface. If wheels 16 are made of polymeric material, rollers 12 can even be set onto a wooden floor without damaging the floor. In addition, wheels 16 may be adapted for their intended use. For example, pneumatic tires can be used for use of rollers 12 on an asphalt surface. Although in this embodiment springs are not present to return rollers 12 to their starting position, in practice there is not a great deal of movement and a paved area that is only slightly larger than rollers 12 can accommodate a bicycle rider training on the wheeled rollers 12.

The front wheel 28 of the bicycle mounted on rollers 12 is prevented from slipping off rollers 12 by a pair of horizontally mounted and rotating rollers 30. Because they are rotatable, rollers 30 constrain front wheel 28 without stopping its braking its rotation, which could cause an accident, potentially injuring the bicycle rider. Likewise for and aft rotatable roller/bumpers 32 prevent further movement when front and rear bicycle wheels 28 and 26 move fore or aft from the intended position on rollers 12. Roller/bumpers 32 act to gently return wheels 28 and 26 to their intended position.

In alternative preferred embodiments, wheels 16 are replaced by some other relative motion permitting assembly adapted to permit for and aft motion between the rider and the surface upon which assembly 10 or other similar assembly is resting. These preferred embodiments include the case in which frame 20 is not provided and wheels 16 rest on some available surface such as a floor or a patio. In this embodiment wheels 16 may be enlarged and/or fitted with pneumatic tires. Other embodiments include cases in which the relative motion permitting assembly includes a frame, such as frame 20, but where wheels 16 are mounted upwardly on frame 20 rather than downwardly on trainer device 12. Alternatively, sliding surfaces on 20 and 12 could provide relative motion, or ball bearings, possibly in races, could provide the relative motion between a frame, such as frame 20 and a trainer device, such as trainer device 12.

In an alternative preferred embodiment of a training assembly 110, a basic trainer 112 is placed on wheels 116 and set into a frame 120 to travel on tracks 122 and is returned to center by springs 124. Trainer 112 keeps bicycle 126 laterally upright and provides resistance to rear wheel 130. A stool 140 is provided for front wheel 128, which does not rotate and will translate in the same constrained manner as rear wheel 130.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A bicycle roller assembly adapted to be mounted on a supporting surface, comprising the assembly:

(a) a roller frame;

(b) a set of rollers, mounted on said roller frame and including:

i) a pair of rollers adapted to support a rear wheel of a bicycle; and ii) a front roller adapted to support a front wheel of a bicycle having its rear wheel supported by said pair of rollers;

(c) a set of rotatable elements mounted on the roller assembly and interposed between said supporting surface and said roller frame, and arranged so as to enable both forward and rearward movement of said roller frame relative to said supporting surface while a bicycle having its wheels supported as recited in paragraph (b) (ii) is pedaled by a user; and (d) a motion limiter, adapted to enable said forward and rearward movement of said roller frame within a finite, nonzero range of movement, and to restrict said movement to remain within said range.

2. The assembly of claim 1, wherein said set of rotatable elements includes a set of wheels rotatably mounted to said roller frame.

3. The assembly of claim 1, wherein said motion limiter includes a stationary frame, adapted to rest on said supporting surface and to be interposed between said supporting surface and said rotatable elements, having an upwardly facing frame surface to support said wherein said limiter further includes front and rear roller frame stop elements.

4. The assembly of claim 3, wherein said rotatable elements are wheels mounted on said roller frame.

5. The assembly of claim 1, wherein said said front roller is rotatably linked to one of said pair of rollers by means of a belt.

6. A bicycle training device, comprising:

(a) a roller;

(b) a rear support adapted to support a rear portion of a bicycle, said rear support supported by said moveable frame and rear support supported by said roller permitting rotation of a rear wheel of said bicycle;

(c) a front support adapted to support a front wheel of a bicycle that is positioned with its rear portion on said rear support;

(e) a set of rotatable elements mounted on the roller assembly and interposed between a supporting surface and said roller frame, said set of rotatable elements facilitating forward, and rearward movement of said roller frame relative to said supporting surface; and (f) a motion limiter, adapted to restrict forward and rearward motion of said roller frame to within a range of movement on said supporting surface.

7. The bicycle roller assembly of claim 1, further including a position drift resisting system that urges said frame towards a position within said range of movement.

8. The bicycle roller assembly of claim 7, wherein said position drift resisting system includes at least one spring positioned so as to urge said roller frame toward said position.

9. The bicycled roller of claim 8 wherein said spring is a bungee and said position drift resisting system includes another bungee, and wherein said two bungees pull said roller frame in opposition directions.

10. The assembly of claim 1, further comprising at least one resilient bias element that opposes movement of said roller frame away from a rest position within said range.

11. The assembly of claim 10, wherein at least one bias element comprises a pair of opposed resilient members.

12. The assembly of claim 10, wherein at least one bias element comprises at least one spring.

13. The assembly of claim 12, wherein at least one spring comprises at least one bungee.

* * * * *

UNITED STATES PATENT AND TRADEMARK OFFICE

CERTIFICATE OF CORRECTION

PATENT NO. : 7,604,575 B2
APPLICATION NO. : 11/520288
DATED : October 20, 2009
INVENTOR(S) : Papadopoulos It is certified that error appears in the above-identified patent and that said Letters Patent is hereby corrected as shown below:

In the drawings, FIG. 1A should be changed to FIG. 1.

Col. 3, line 32, Replace "comprising the assembly" with -- the assembly comprising --.

Col. 4, line 16, please insert -- frame -- before -- roller --.

Signed and Sealed this
Fourth Day of September, 2012

David J. Kappos

David J. Kappos
*Director of the United States Patent and Trademark Office*